US010828741B1

(12) United States Patent
McFadden

(10) Patent No.: US 10,828,741 B1
(45) Date of Patent: Nov. 10, 2020

(54) WOOD SANDER

(71) Applicant: Royce McFadden, Olton, TX (US)

(72) Inventor: Royce McFadden, Olton, TX (US)

( * ) Notice: Subject to any disclaimer, the term of this patent is extended or adjusted under 35 U.S.C. 154(b) by 0 days.

(21) Appl. No.: 15/929,813

(22) Filed: May 22, 2020

(51) Int. Cl.

| | |
|---|---|
| ***B24B 21/06*** | (2006.01) |
| ***B24B 7/07*** | (2006.01) |
| ***B24B 7/28*** | (2006.01) |
| ***B24B 7/06*** | (2006.01) |
| ***B24B 47/00*** | (2006.01) |
| ***B24B 41/02*** | (2006.01) |
| *B24B 41/06* | (2012.01) |

(52) U.S. Cl.
CPC ..... *B24B 21/06* (2013.01); *B24B 7/06* (2013.01); *B24B 7/28* (2013.01); *B24B 41/02* (2013.01); *B24B 47/00* (2013.01); *B24B 41/06* (2013.01)

(58) Field of Classification Search
CPC .. B24B 21/06; B24B 7/06; B24B 7/28; B24B 41/02; B24B 47/00; B24B 41/06; B24B 21/00; B24B 21/04; B24B 29/005; B24D 99/00; B24D 13/06; B24D 13/10
See application file for complete search history.

(56) References Cited

U.S. PATENT DOCUMENTS

| | | | | |
|---|---|---|---|---|
| 1,699,764 | A * | 1/1929 | Solem | B24B 7/12 198/834 |
| 2,069,900 | A * | 2/1937 | Perazzoli | B24D 99/00 451/298 |
| 7,789,735 | B2 * | 9/2010 | Weiland | B24D 13/04 451/182 |
| 9,855,640 | B2 * | 1/2018 | Krummenauer | B24D 13/04 |
| 2005/0130570 | A1 * | 6/2005 | von Schumann | B24B 27/0076 451/184 |
| 2011/0312257 | A1 * | 12/2011 | Cassara | B24D 13/12 451/531 |
| 2016/0375541 | A1 * | 12/2016 | Weber | B24B 7/06 451/298 |

* cited by examiner

*Primary Examiner* — Dung Van Nguyen
(74) *Attorney, Agent, or Firm* — Shannon Warren

(57) ABSTRACT

A wood sander for sanding a target object. The wood sander comprises a frame, an upper assembly, a lower assembly, a drive system and a plurality of sandpaper sheets. The drive system is configured for pulling the plurality of sandpaper sheets through a path. The path is configured to cause the plurality of sandpaper sheets to touch a portion of the target object as the drive system rotates the plurality of sandpaper sheets. The upper assembly comprises the drive system, and the plurality of sandpaper sheets. The lower assembly comprises a platform configured to hold the target object. The upper assembly and the lower assembly are attached to and supported by the frame.

18 Claims, 16 Drawing Sheets

WOOD SANDER

CROSS-REFERENCE TO RELATED APPLICATIONS

Not applicable.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

BRIEF SUMMARY OF THE INVENTION

A wood sander for sanding a target object. Said wood sander comprises a frame, an upper assembly, a lower assembly, a drive system and a plurality of sandpaper sheets. Said drive system is configured for pulling said plurality of sandpaper sheets through a path. Said path is configured to cause said plurality of sandpaper sheets to touch a portion of said target object as said drive system rotates said plurality of sandpaper sheets. Said upper assembly comprises said drive system, and said plurality of sandpaper sheets. Said lower assembly comprises a platform configured to hold said target object. Said upper assembly and said lower assembly are attached to and supported by said frame.

Said wood sander for sanding said target object. Said wood sander comprises said frame, said upper assembly, said lower assembly, said drive system and said plurality of sandpaper sheets. Said drive system is configured for pulling said plurality of sandpaper sheets through said path. Said path is configured to cause said plurality of sandpaper sheets to touch a portion of said target object as said drive system rotates said plurality of sandpaper sheets. Said upper assembly comprises said drive system, and said plurality of sandpaper sheets. Said lower assembly comprises said platform configured to hold said target object. Said upper assembly and said lower assembly are attached to and supported by said frame. each of a four or more corner posts comprises a substantially vertical support at the corners of said frame. A first drive rotating axis is arranged at a first end of said frame, and runs through a portion of a first corner post and a second corner post. A second drive rotating axis is arranged at a second end of said frame and runs through a portion of a third corner post and a fourth corner post. Said four or more corner posts comprises a bottom end and a top end. Said top end each of said four or more corner posts comprises an axial aperture. Said axial aperture of said first corner post is aligned with said axial aperture of said second corner post. Said axial aperture of said third corner post is aligned with said axial aperture of said fourth corner post. Said wood sander further comprises two or more drive rods comprising a first drive rod and a second drive rod. Said first drive rod runs between each said axial aperture of said first corner post and said second corner post. Said second drive rod runs between said axial aperture of said third corner post and said fourth corner post. Said drive system is arranged with a two sides comprising a first side and a second side. each of said two sides comprise a two or more sprockets attached to said two or more drive rods, and a chain composed of a plurality of chain link sockets. Said two or more sprockets comprise at least a first sprocket and a second sprocket, with said first sprocket rotating about said first drive rotating axis and said second sprocket rotating about said second drive rotating axis. Said chain is wrapped around said two or more sprockets on each of said two sides to form said path. Said drive system is configured to pull said plurality of sandpaper sheets around said path between said two or more sprockets on said chain. Said chain is configured to circulate along said path according to a shape created by said two or more sprockets. Said path selectively changes between a slack configuration and an engaged configuration with a variable engagement assembly. Said two or more sprockets comprise said first sprocket, said second sprocket, a third sprocket and a fourth sprocket. Said slack configuration comprises a configuration of said two or more sprockets with said third sprocket and said fourth sprocket unengaged with said chain, a top portion of said chain substantially tight between said first sprocket and said second sprocket, and a bottom portion of said chain hanging unengaged below said third sprocket and said fourth sprocket. 1 said variable engagement assembly comprises, on each side of said two sides, a lower bar, an upper bar, and a plurality of rocker bars. Said wood sander comprises a sandpaper holder assembly. Said sandpaper holder assembly comprises a sandpaper sheet, and one or more cross-members. each of said one or more cross-members comprises a mounting bracket on each end. Said one or more cross-members of said sandpaper holder assembly attach to said chain with said mounting bracket. with said one or more cross-members attached to said chain, said chain is still capable of rotating around said path and said two or more sprockets unimpeded. Said mounting bracket is configured to selectively attach to said chain to hold said sandpaper holder assembly to said chain.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
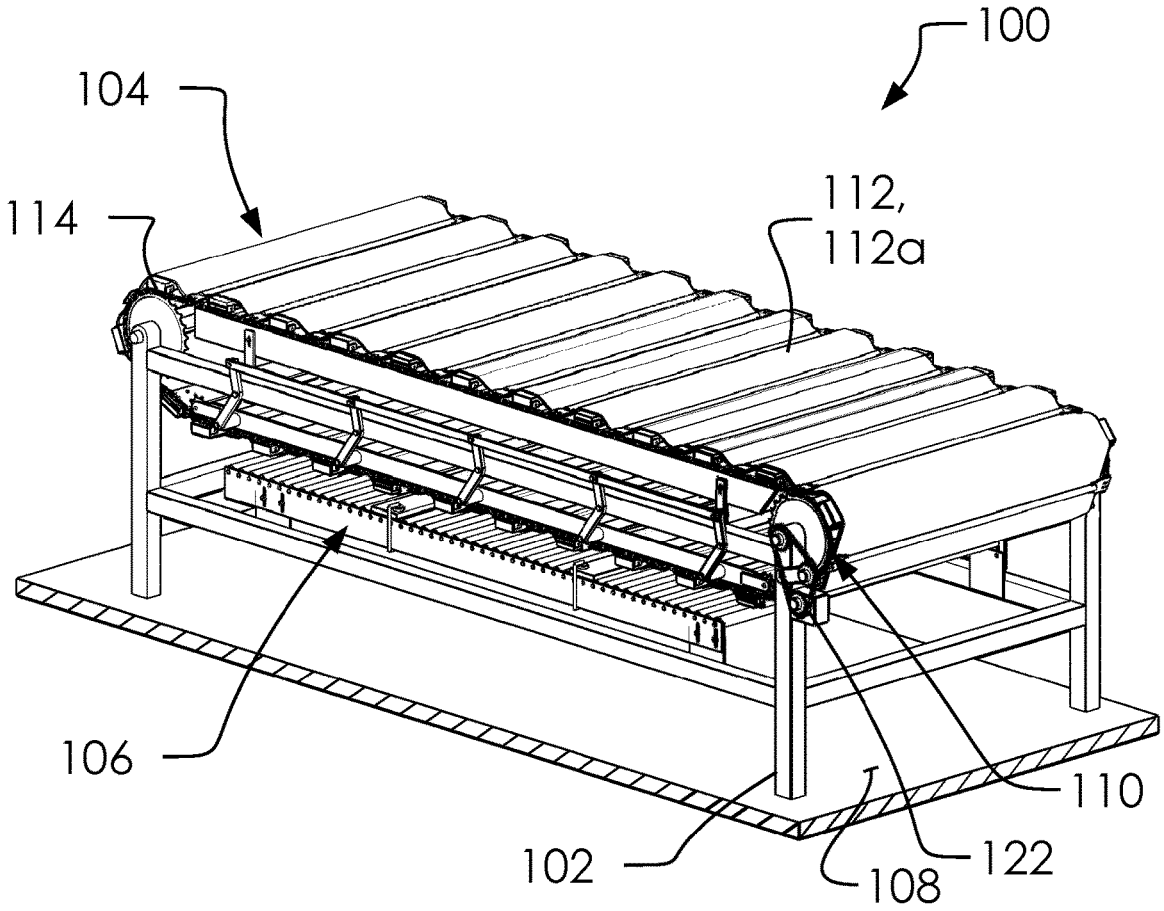
FIGS. 1A and 1B illustrate a perspective overview of a wood sander 100.
Figure 1B:
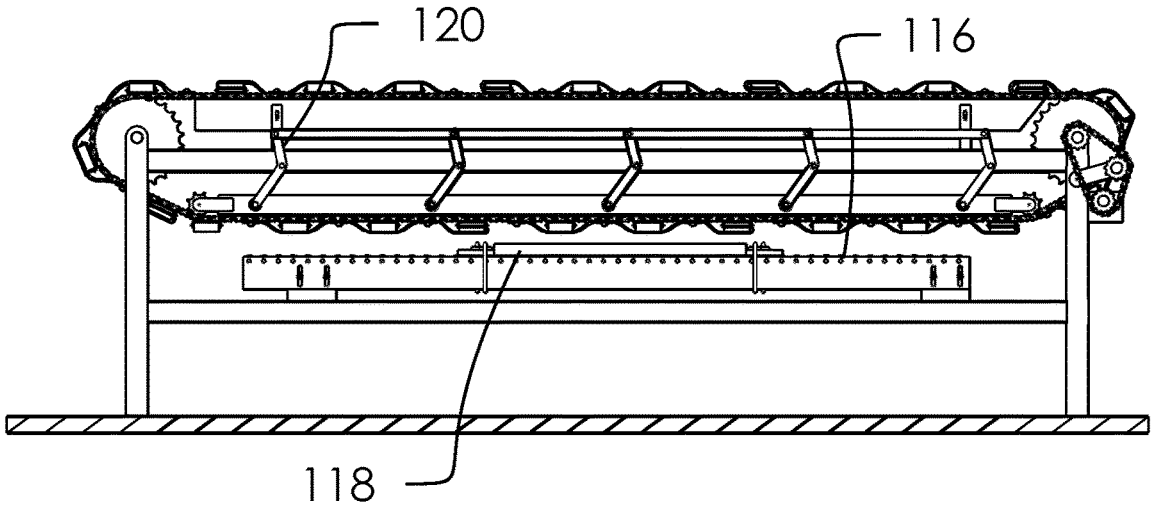

FIGS. 1A and 1B illustrate a perspective overview of a wood sander 100.

In one embodiment, said wood sander 100 can comprise a frame 102, an upper assembly 104, a lower assembly 106, and a variable engagement assembly 120.

In one embodiment, said frame 102 can support said wood sander 100 over a ground surface 108, as illustrated.

Said upper assembly 104 can comprise a drive system 110 configured to drive a plurality of sandpaper sheets 112 around a path 114.

Said lower assembly 106 can comprise a platform 116 configured to hold a target object 118 against a portion of said plurality of sandpaper sheets 112 as they progress around said path 114 driven by a rotary power input 122. In one embodiment, said rotary power input 122 can comprise an electric motor.

Figure 2A:
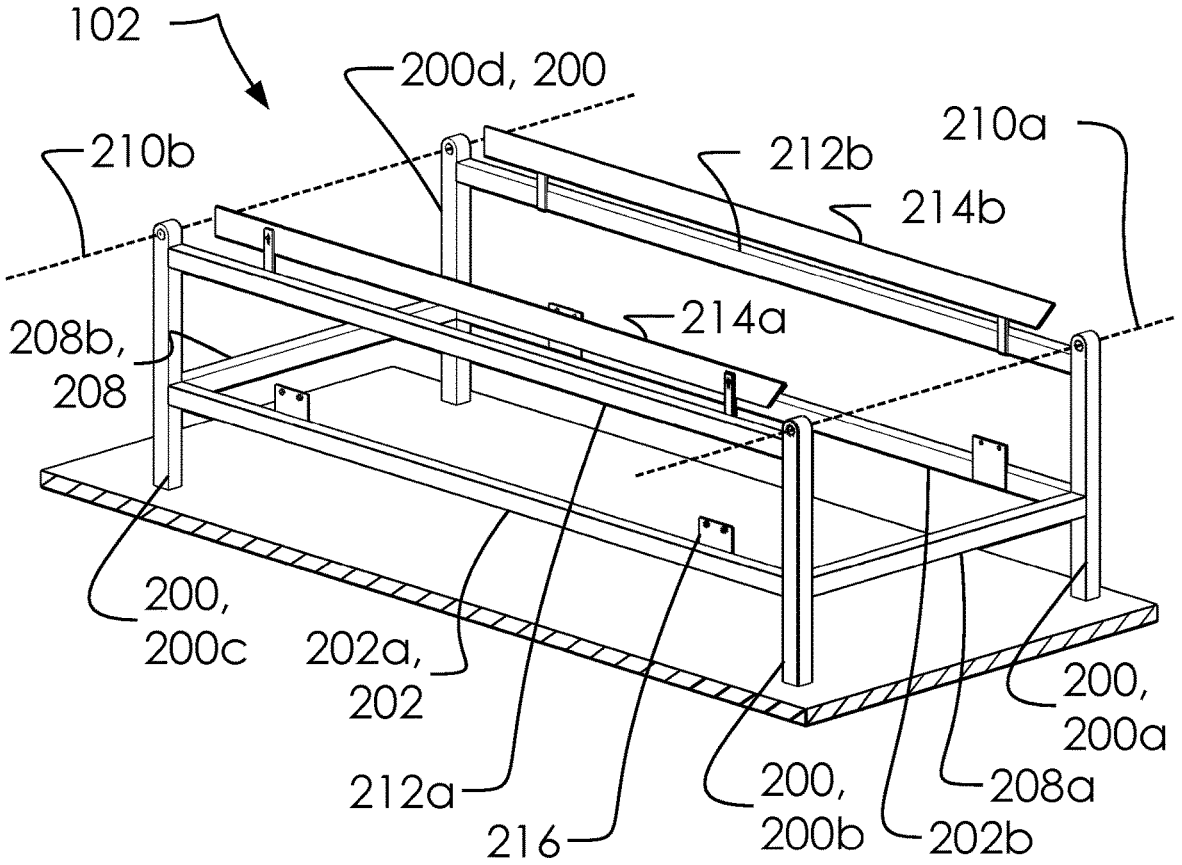
FIGS. 2A and 2B illustrate a perspective overview and an elevated top view of a frame 102.
Figure 2B:
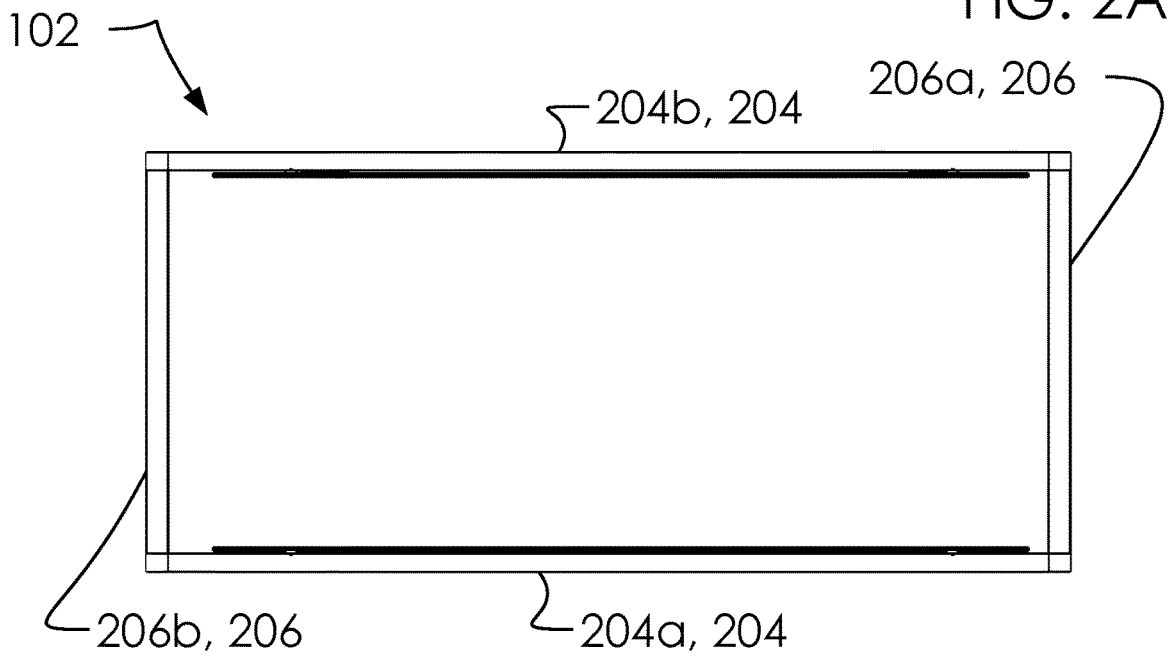

FIGS. 2A and 2B illustrate a perspective overview and an elevated top view of said frame 102.

In one embodiment, said frame 102 can comprise a four or more corner posts 200 (which can comprise a first corner post 200*a*, a second corner post 200*b*, a third corner post 200*c*, and a fourth corner post 200*d*), a one or more lower side rails 202 (which can comprise a first lower side rail 202*a*, and a second lower side rail 202*b*), a two sides 204 (which can comprise a first side 204*a*, and a second side 204*b*), a two ends 206 (which can comprise a first end 206*a*, and a second end 206*b*), a one or more lower end rails 208 (which can comprise a first lower end rail 208*a*, and a second lower end rail 208*b*), a one or more drive rotating axes 210 (which can comprise a first drive rotating axis 210*a*, and a second drive rotating axis 210*b*), a one or more upper side rails 212 (which can comprise a first upper side rail 212*a*, and a second upper side rail 212*b*), a one or more upper side containment rails 214 (which can comprise a first upper side containment rail 214*a*, and a second upper side containment rail 214*b*) and a one or more platform brackets 216 (which can comprise a first platform bracket 216*a*, a second platform bracket 216*b*, a third platform bracket 216*c*, and a fourth platform bracket 216*d*).

Figure 3:
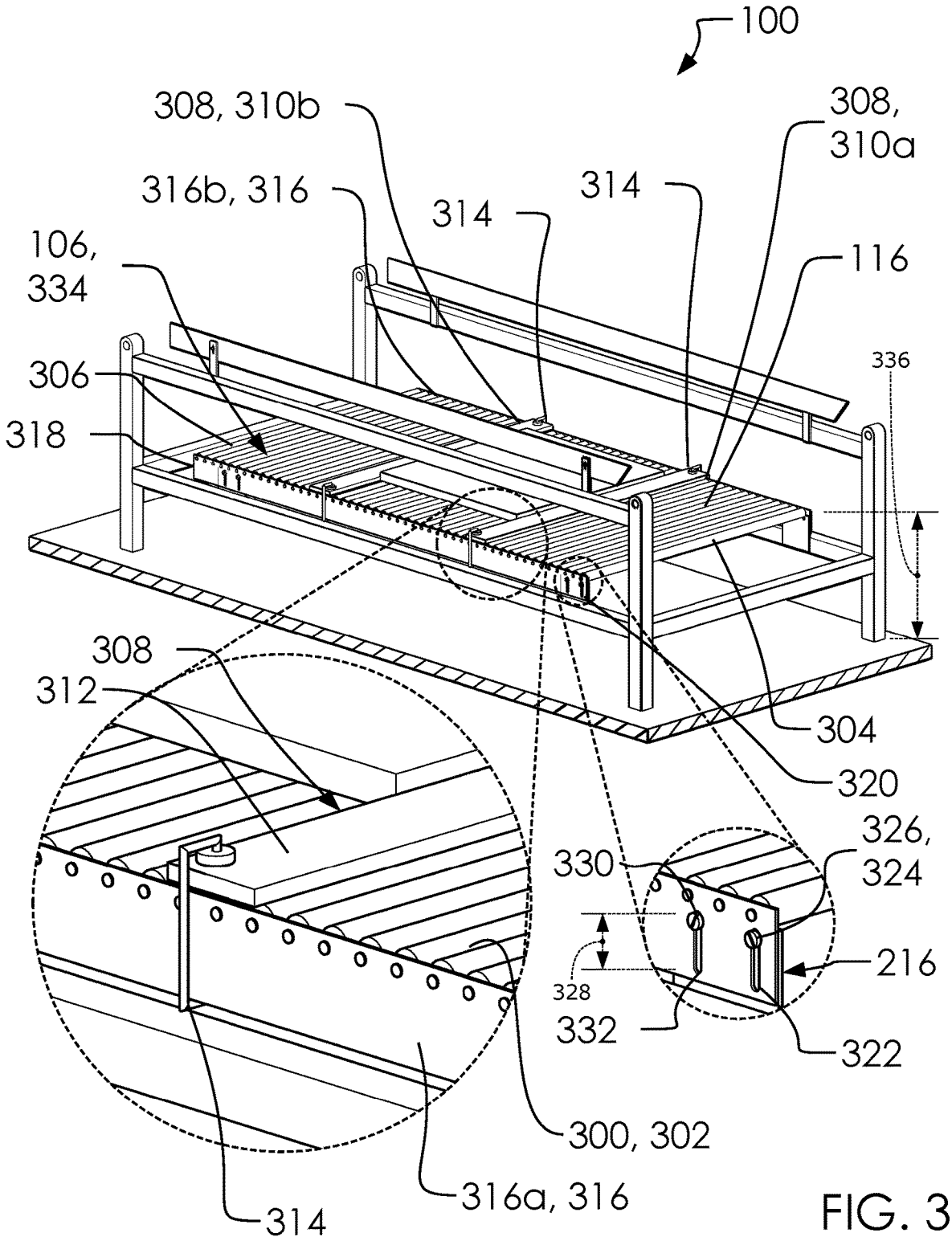
FIG. 3 illustrates a perspective overview of said frame 102 with a lower assembly 106 in a low configuration 334.

FIG. 3 illustrates a perspective overview of said frame 102 with said lower assembly 106 in a low configuration 334.

In one embodiment, said lower assembly 106 can comprise said platform 116 comprising a substantially planar lower surface for selectively holding said target object 118.

Said platform 116 can comprise a plurality of rollers 300 to form a roller bed surface 302. In one embodiment, said roller bed surface 302 can allow said target object 118 to freely slide along said platform 116 between a first platform end 304 and a second platform end 306. In one embodiment, said target object 118 can roll in a forward and back direction between said first platform end 304 and said second platform end 306 to assist in loading and unloading said target object 118.

In one embodiment, said target object 118 can be held in position on said platform 116 with a clamping system 308 which can comprise a first end blocker 310*a* and a second end blocker 310*b* arranged on either side of said target object 118. Each of said first end blocker 310*a* and said second end blocker 310*b* can comprise a board 312 held by one or more locking grips 314. Each of said first end blocker 310*a* and said second end blocker 310*b* can comprise said board 312 being pressed against either side of said target object 118 and held in place with by said one or more locking grips 314. Said one or more locking grips 314 can clamp around said board 312 and a portion of said platform 116.

In one embodiment, said lower assembly 106 can comprise a side supports 316 (which can comprise a first side 316*a*, and a second side 316*b*). said side supports 316 can comprise substantially vertical planar members configured to hold an ends of said plurality of rollers 300.

In one embodiment, each of said side supports 316 can comprise a first end 318 and a second end 320, each comprising one or more slots 322. In one embodiment, said one or more platform brackets 216 can each comprise one or more fasteners 324 each comprising a fastener head 326. In one embodiment, said fastener head 326 can selectively slide within said one or more slots 322. Said one or more slots 322 can comprise a substantially vertical slot having a height 328, a top end 330 and a bottom end 332. Wherein, said lower assembly 106 can move substantially the range of motion defined by a distance (said height 328) between said bottom end 332 and said top end 330.

Said low configuration 334 can comprise said fastener head 326 at said top end 330 of said one or more slots 322. Likewise, said low configuration 334 can comprise said lower assembly 106 at a low configuration height 336 over said ground surface 108.

Figure 4:
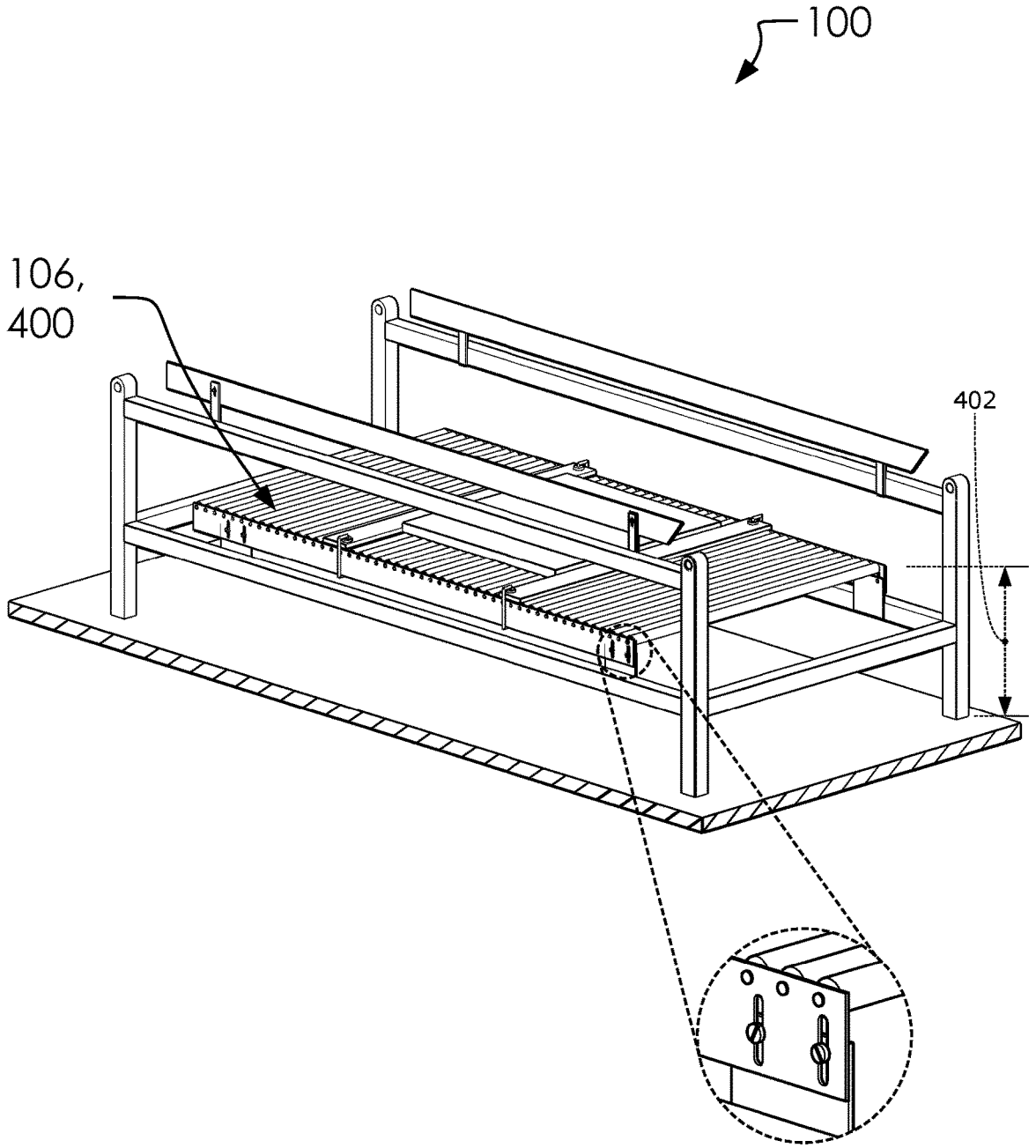
FIG. 4 illustrates a perspective overview of said frame 102 with said lower assembly 106 in a second height configuration 400.

FIG. 4 illustrates a perspective overview of said frame 102 with said lower assembly 106 in a second height configuration 400.

In one embodiment, said second height configuration 400 can comprise said lower assembly 106 raised such that said fastener head 326 are between said top end 330 and said bottom end 332. Further, said second height configuration 400 can comprise said lower assembly 106 at a second height 402 over said ground surface 108.

Figure 5:
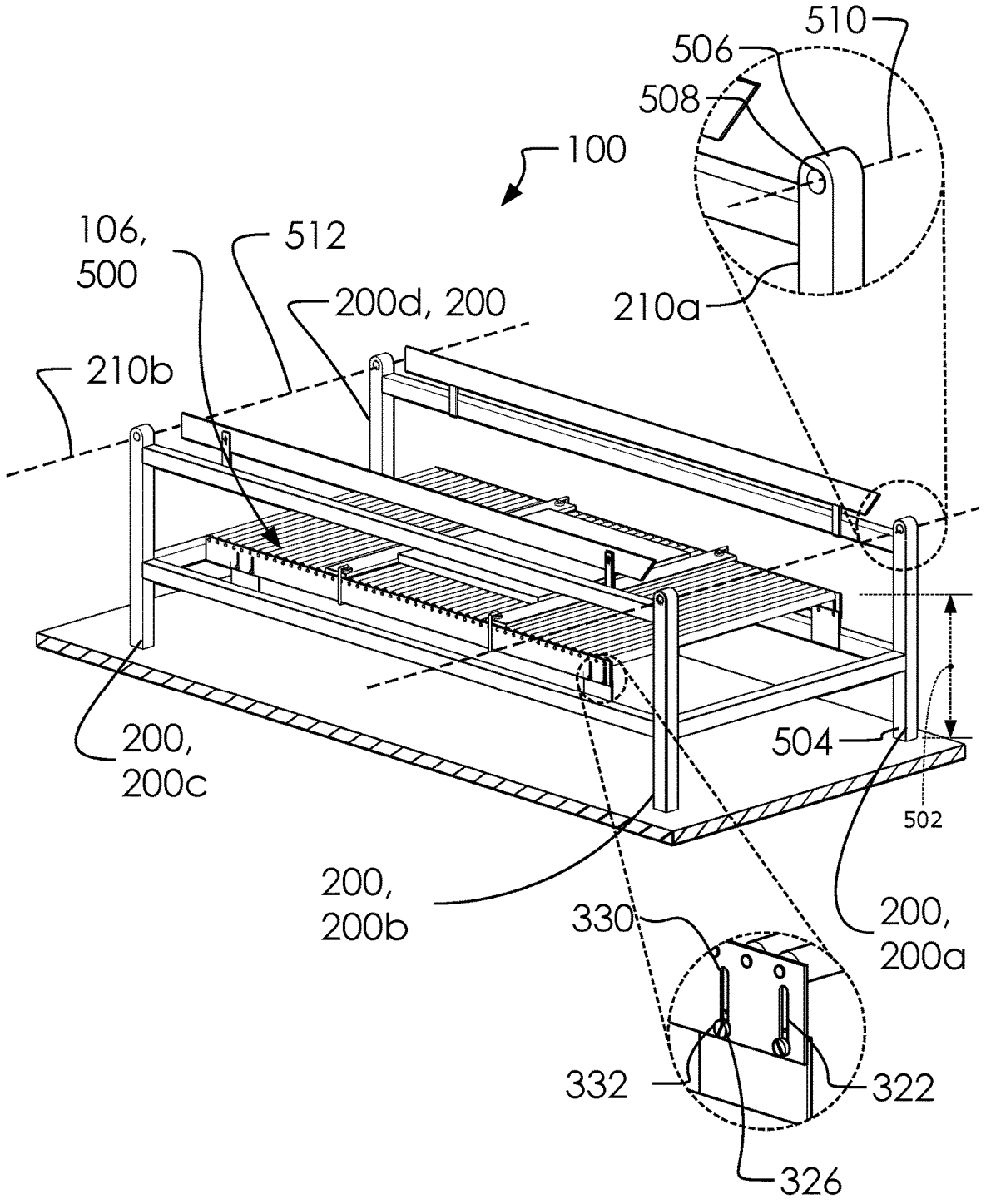
FIG. 5 illustrates a perspective overview of said frame 102 with said lower assembly 106 in a high configuration 500.

FIG. 5 illustrates a perspective overview of said frame 102 with said lower assembly 106 in a high configuration 500.

In one embodiment, said high configuration 500 can comprise said lower assembly 106 at a high configuration height 502 over said ground surface 108, as illustrated. Likewise, said high configuration 500 can comprise said fastener head 326 at said bottom end 332 of said one or more slots 322.

In one embodiment, each of said four or more corner posts 200 can comprise a substantially vertical support at the corners of said frame 102. Said four or more corner posts 200 can comprise a bottom end 504 and a top end 506. In one embodiment, said top end 506 can comprise an axial aperture 508 being aligned along either a first drive system axis 510 or a second drive system axis 512.

Figure 6:
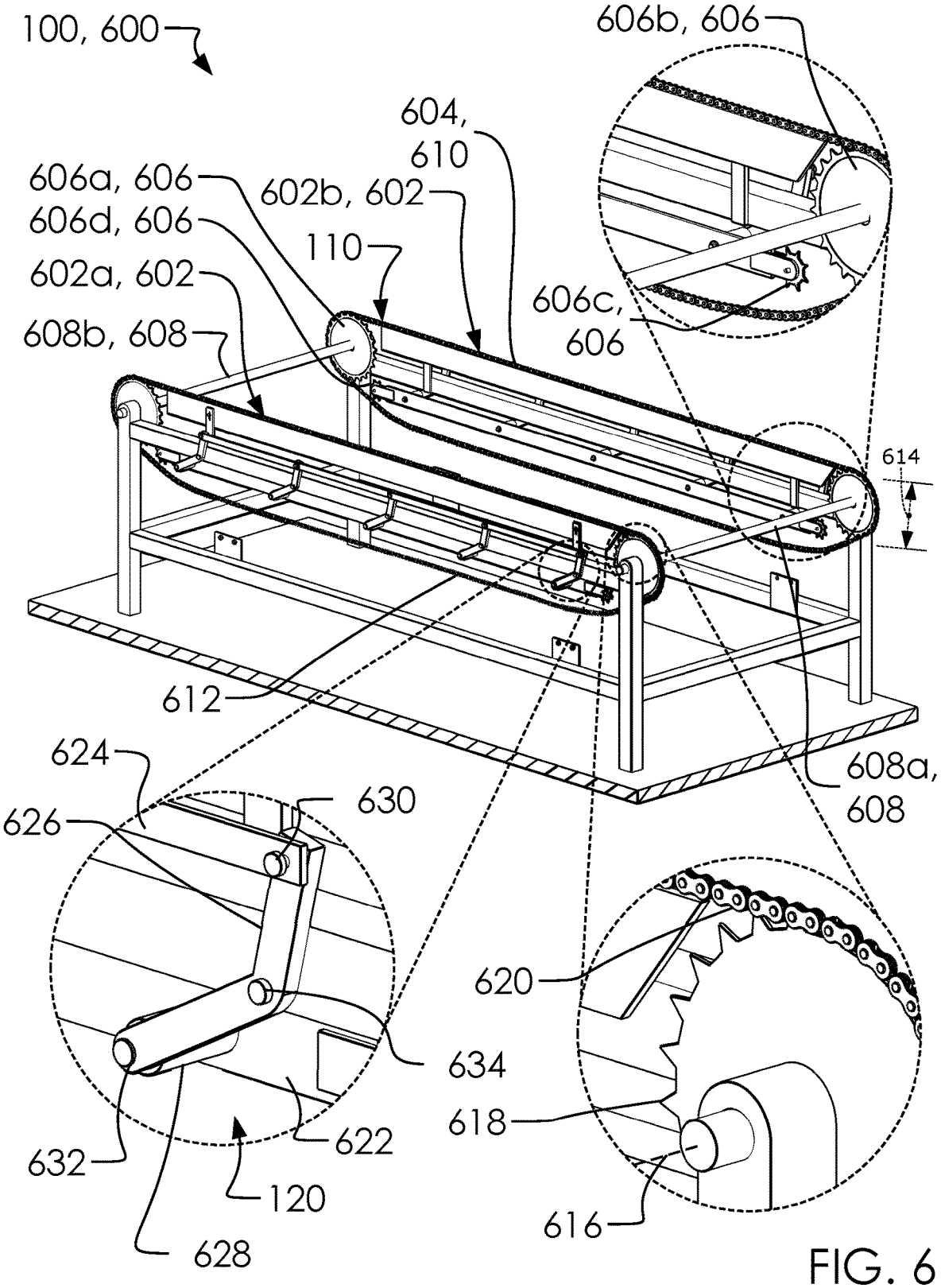
FIG. 6 illustrates a perspective overview of said wood sander 100 with a drive system 110 in a slack configuration 600.

FIG. 6 illustrates a perspective overview of said wood sander 100 with said drive system 110 in a slack configuration 600.

In one embodiment, said drive system 110 can comprise a two sides 602 (which can comprise a first side 602*a*, and a second side 602*b*). Each of said two sides 602 can comprise a chain 604, and a two or more sprockets 606 (which can comprise a first sprocket 606*a*, a second sprocket 606*b*, a third sprocket 606*c*, and a fourth sprocket 606*d*).

Said two sides 602 can be connected to one another by two or more drive rods 608 (which can comprise a first drive rod 608*a*, and a second drive rod 608*b*). said first drive rod 608*a* can connect said second sprocket 606*b* of said first side 602*a* with said second sprocket 606*b* of said second side 602*b*; and said second drive rod 608*b* can connect said first sprocket 606*a* of said first side 602*a* with said first sprocket 606*a* of said second side 602*b*.

Said chain 604 can circulate along said path 114 according to a shape created by said two or more sprockets 606. For example, said slack configuration 600 can comprise a configuration of said two or more sprockets 606 with said third sprocket 606*c* and said fourth sprocket 606*d* unengaged with said chain 604, wherein a top portion 610 of said chain 604 is substantially tight between said first sprocket 606*a* and said second sprocket 606*b*, but a bottom portion 612 of said chain 604 hanging unengaged below said third sprocket 606*c* and said fourth sprocket 606*d*.

Said two or more sprockets 606 can comprise a diameter 614, a rotational axis 616, and a plurality of teeth 618. In one embodiment, said plurality of teeth 618 of said two or more sprockets 606 engage with a plurality of chain link sockets 620 in said chain 604, as is known in the art. Said rotational axis 616 can be aligned with said first drive system axis 510 and said second drive system axis 512. In one embodiment, said diameter 614 can be dissimilar with said first sprocket 606*a* and said second sprocket 606*b* being similar, and said third sprocket 606*c* and said fourth sprocket 606*d* being smaller, as illustrated.

In one embodiment, said variable engagement assembly 120 can comprise a lower bar 622, an upper bar 624, and a plurality of rocker bars 626. In one embodiment, said plurality of rocker bars 626 can be arranged along the length of and be rotationally attached to said lower bar 622, said one or more upper side rails 212 and said upper bar 624. In one embodiment, one or more spacers 628 can be used to connect said plurality of rocker bars 626 to parts of said variable engagement assembly 120, as illustrated. Said plurality of rocker bars 626 can allow said variable engagement assembly 120 to rotate about a top fastener 6301, said lower bar 622 to rotate about a lower fastener 632, and said plurality of rocker bars 626 rotates about a fixed axis at a center fastener 634.

Figure 7:
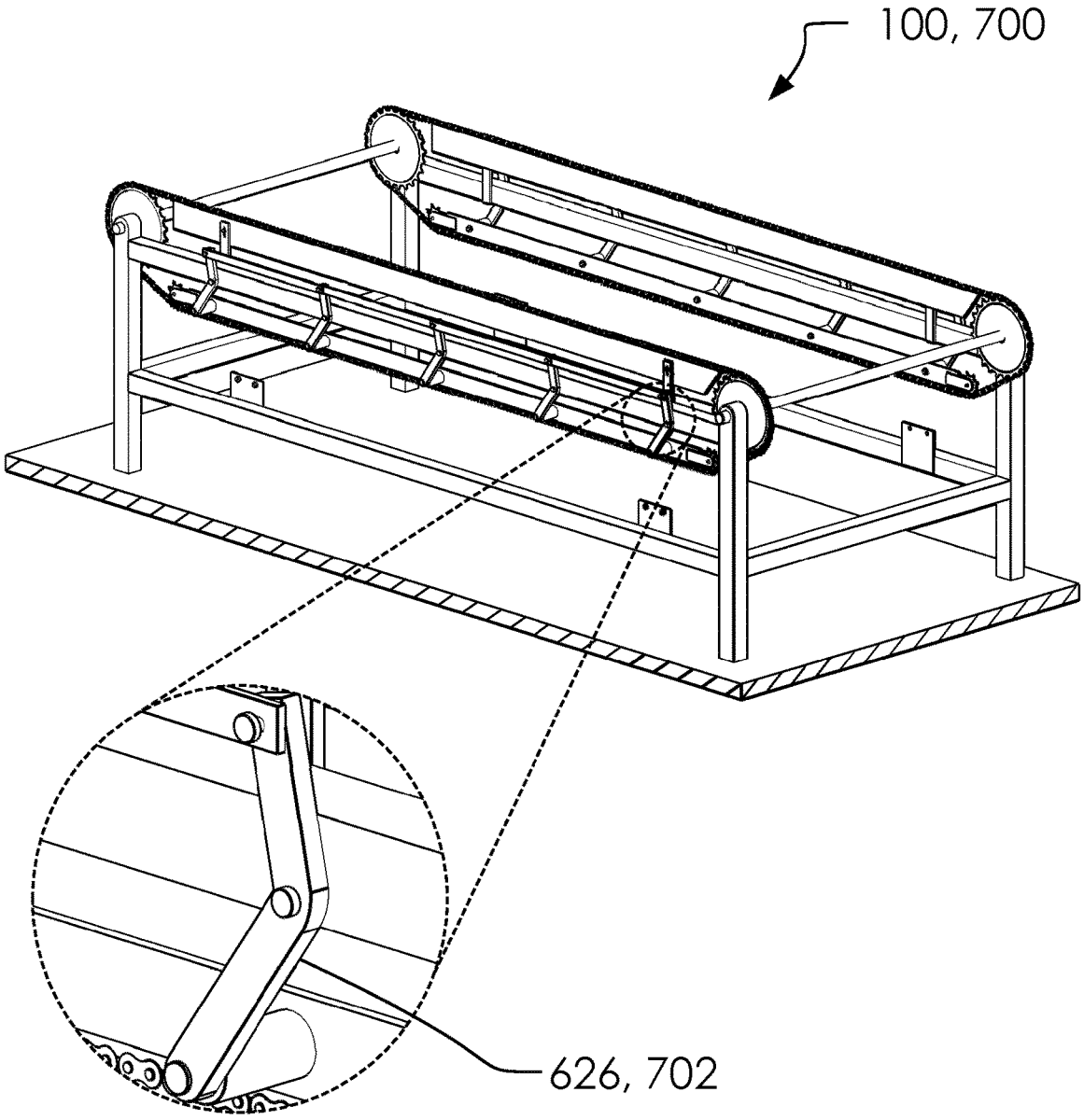
FIG. 7 illustrates a perspective overview of said wood sander 100 with said drive system 110 and a chain 604 in an engaged configuration 700.

FIG. 7 illustrates a perspective overview of said wood sander 100 with said drive system 110 and said chain 604 in an engaged configuration 700.

In one embodiment, said engaged configuration 700 can comprise said chain 604 engaged with all of said two or more sprockets 606 at the same time, wherein said path 114 is straight at said top portion 610 and said bottom portion 612.

Figure 8A:
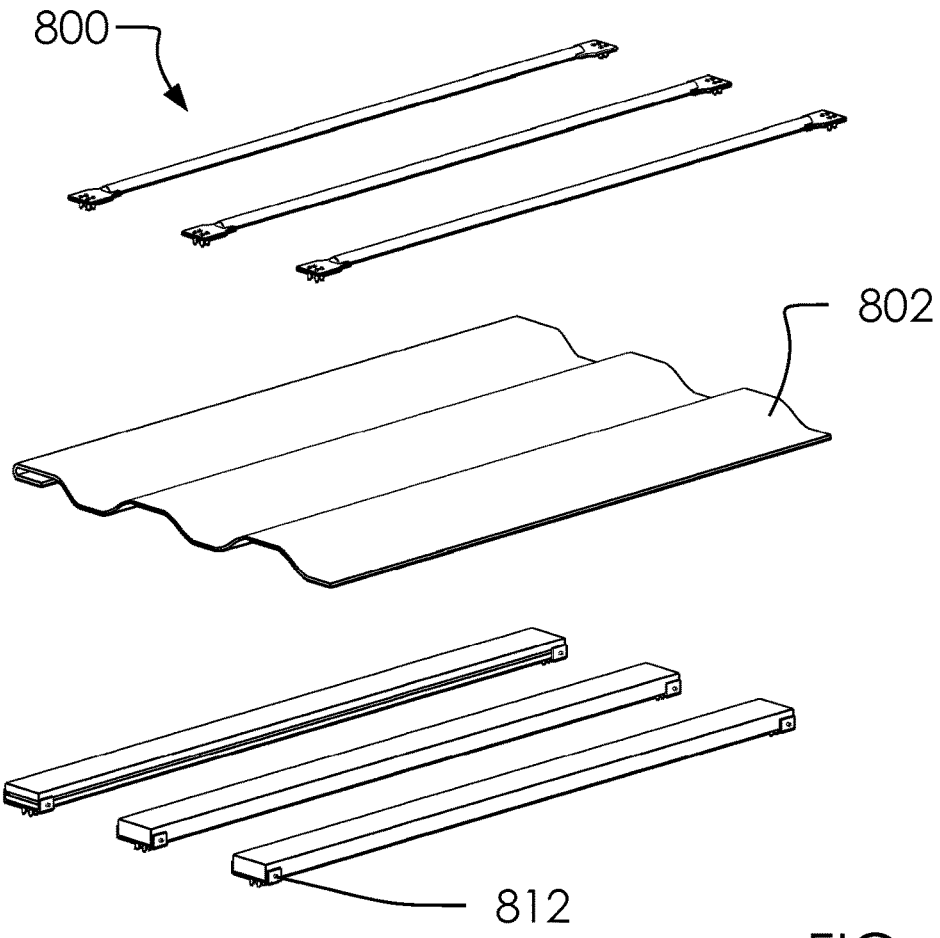
FIGS. 8A, and 8B illustrate a sandpaper holder assembly 800 in an exploded perspective overview and an assembled elevated side view, respectively.
Figure 8B:
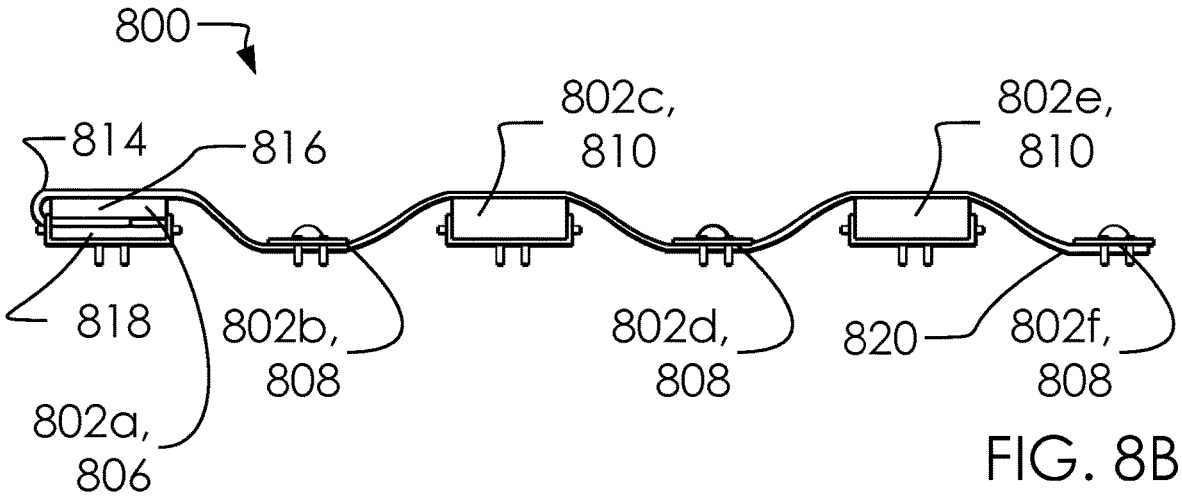

FIGS. 8A, and 8B illustrate a sandpaper holder assembly 800 in an exploded perspective overview and an assembled elevated side view, respectively.

In one embodiment, said wood sander 100 can comprise said sandpaper holder assembly 800.

In one embodiment, said sandpaper holder assembly 800 can comprise a sandpaper sheet 802, and one or more cross-members 804 (which can comprise a first cross-member 804*a*, a second cross-member 804*b*, a third cross-member 804*c*, a fourth cross-member 804*d*, a fifth cross-member 804*e*, and a sixth cross-member 8040. said one or more cross-members 804 can comprise different varieties such as a clamping assembly 806, a cross-member bar 808, and a cross-member board 810.

Each of said one or more cross-members 804 can comprise a mounting bracket 812 on each end. In one embodiment, said mounting bracket 812 can selectively attach to said chain 604 to hold said sandpaper holder assembly 800 to said chain 604.

In one embodiment, said clamping assembly 806 can clamp around a first end 814 of said sandpaper sheet 802 by securing said first end 814 between a top board 816 and a bottom board 818. In one embodiment, a second end 820 of said sandpaper sheet 802 can remain lose so that said sandpaper holder assembly 800 can stretch and flex as said drive system 110 rotates through said path 114.

Figure 9A:
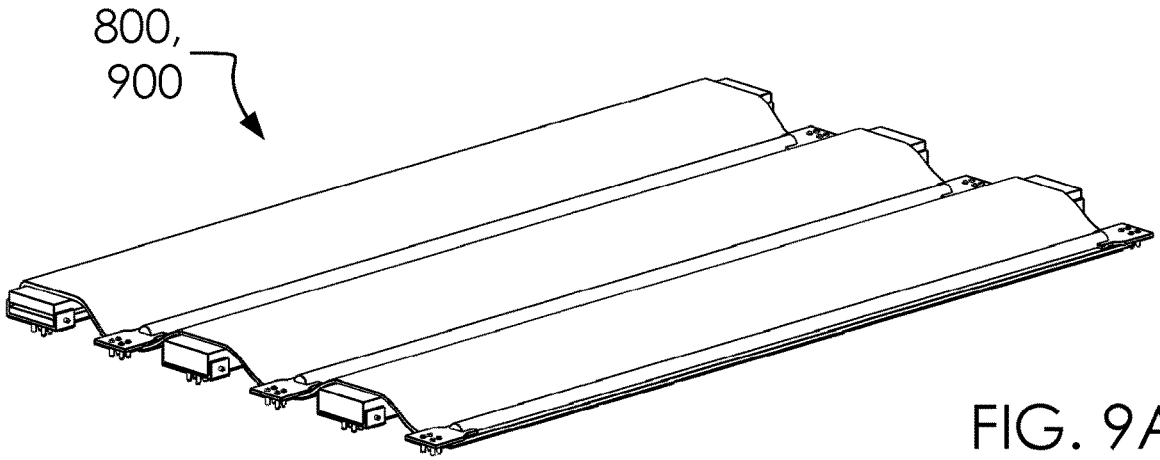
FIGS. 9A, 9B, and 9C illustrate two perspective overviews and a perspective lower view of said sandpaper holder assembly 800 in an assembled configuration 900.
Figure 9B:
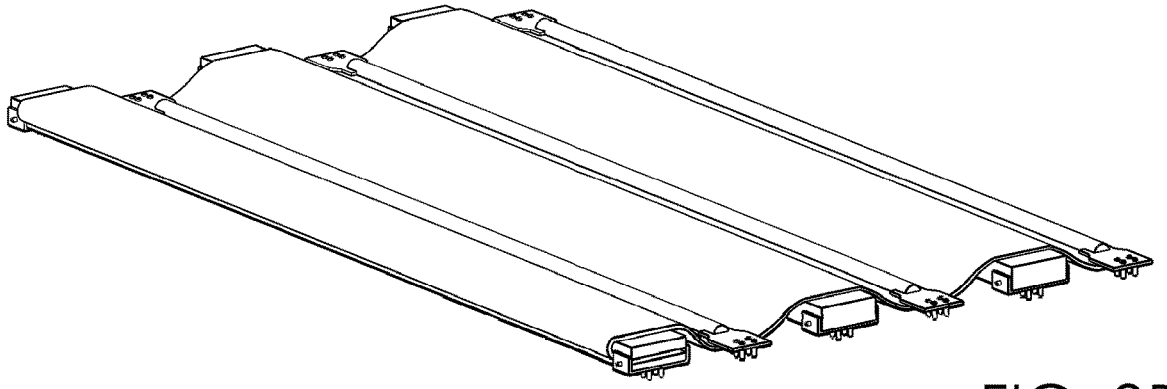
Figure 9C:
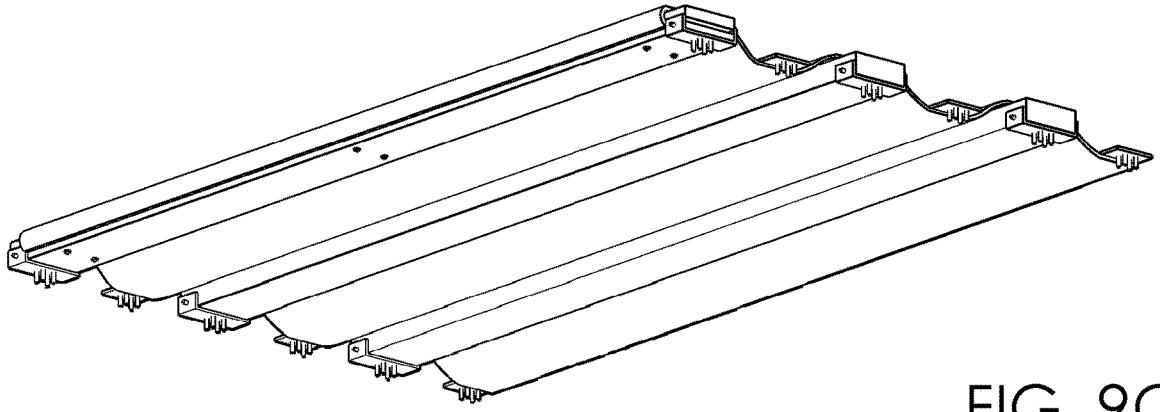

FIGS. 9A, 9B, and 9C illustrate two perspective overviews and a perspective lower view of said sandpaper holder assembly 800 in an assembled configuration 900.

Figure 10:
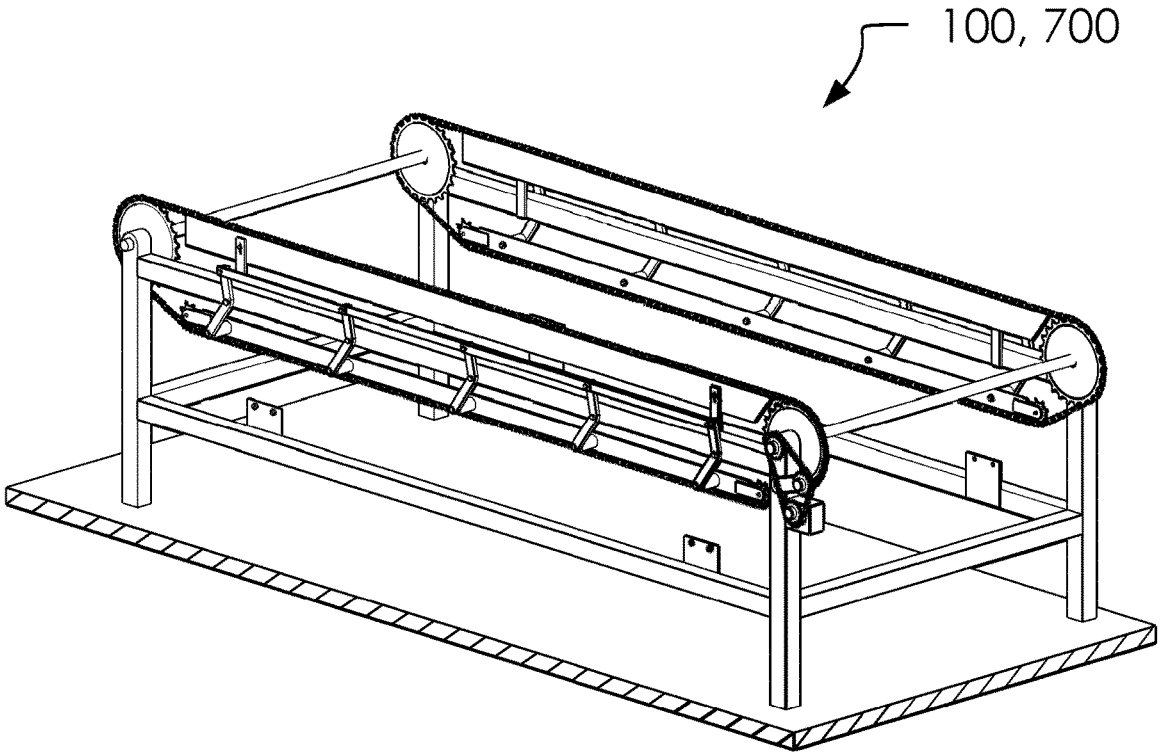
FIG. 10 illustrates a perspective overview of said frame 102 with said drive system 110 attached, and in said engaged configuration 700

FIG. 10 illustrates a perspective overview of said frame 102 with said drive system 110 attached, and in said engaged configuration 700

Figure 11:
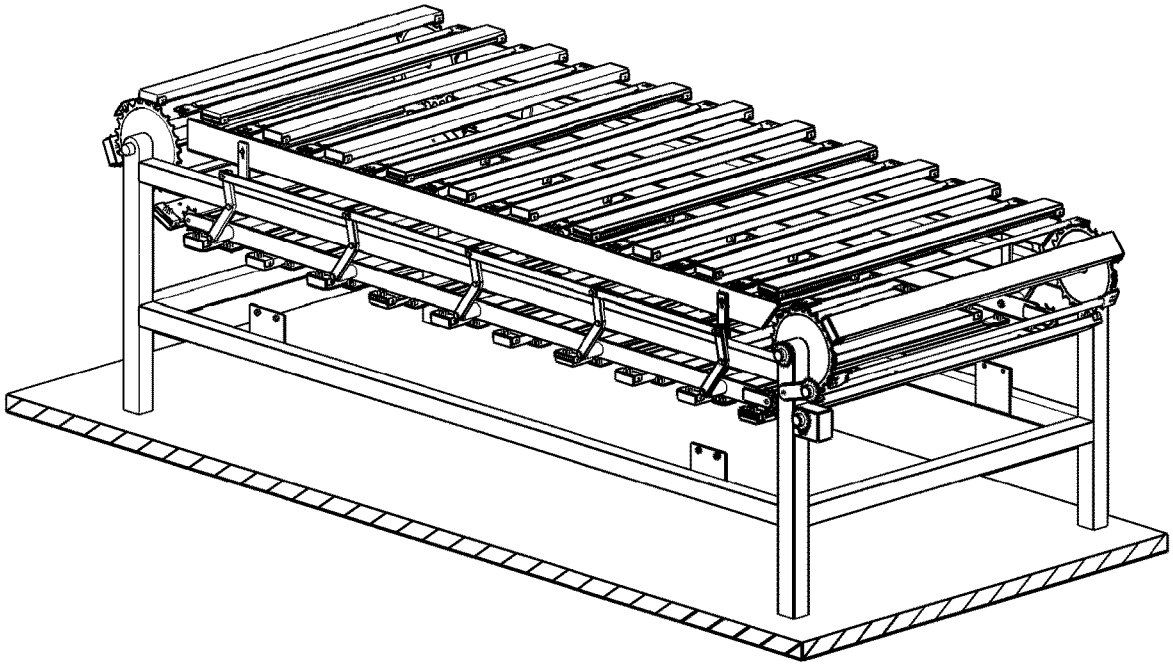
FIG. 11 illustrates a perspective overview of said frame 102, said drive system 110, and one or more cross-members 804.

FIG. 11 illustrates a perspective overview of said frame 102, said drive system 110, and said one or more cross-members 804.

In one embodiment, said one or more cross-members 804 of said sandpaper holder assembly 800 attach to said chain 604 with said mounting bracket 812. With said one or more cross-members 804 attached to said chain 604, said chain 604 is still able to rotate around said path 114 and said two or more sprockets 606 unimpeded.

In one embodiment, said plurality of sandpaper sheets 112 can be attach to said chain 604 without said one or more cross-members 804 and thereby circulate without the added complexity. However, by including said one or more cross-members 804, said plurality of sandpaper sheets 112 can expand and contract around said path 114.

Likewise, with said one or more cross-members 804, portions of said plurality of sandpaper sheets 112 can be selectively pressed into said target object 118 by adjusting said clamping system 308. For example, said clamping system 308 can be opened, said sandpaper sheet 802 can be cut and pulled to a new position relative to said clamping assembly 806 and said cross-member board 810, and re-clamped. Accordingly, a new portion of said sandpaper sheet 802 can sit on top of said clamping assembly 806 and said cross-member board 810.

In one embodiment, said one or more upper side containment rails 214 can support said chain 604 at said top portion 610 so as to align said chain 604 between said first sprocket 606*a* and said second sprocket 606*b*.

Figure 12:
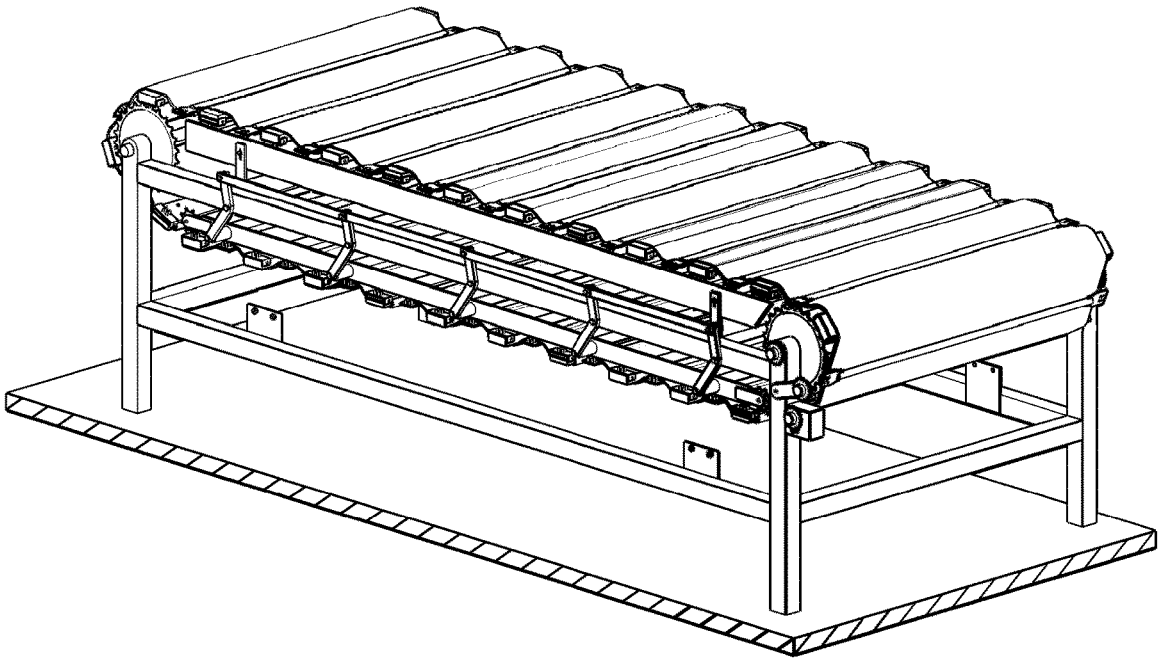
FIG. 12 illustrates a perspective overview with said drive system 110 and a plurality of sandpaper sheets 112 with said one or more cross-members 804 installed.

FIG. 12 illustrates a perspective overview with said drive system 110 and said plurality of sandpaper sheets 112 with said one or more cross-members 804 installed.

Figure 13A:
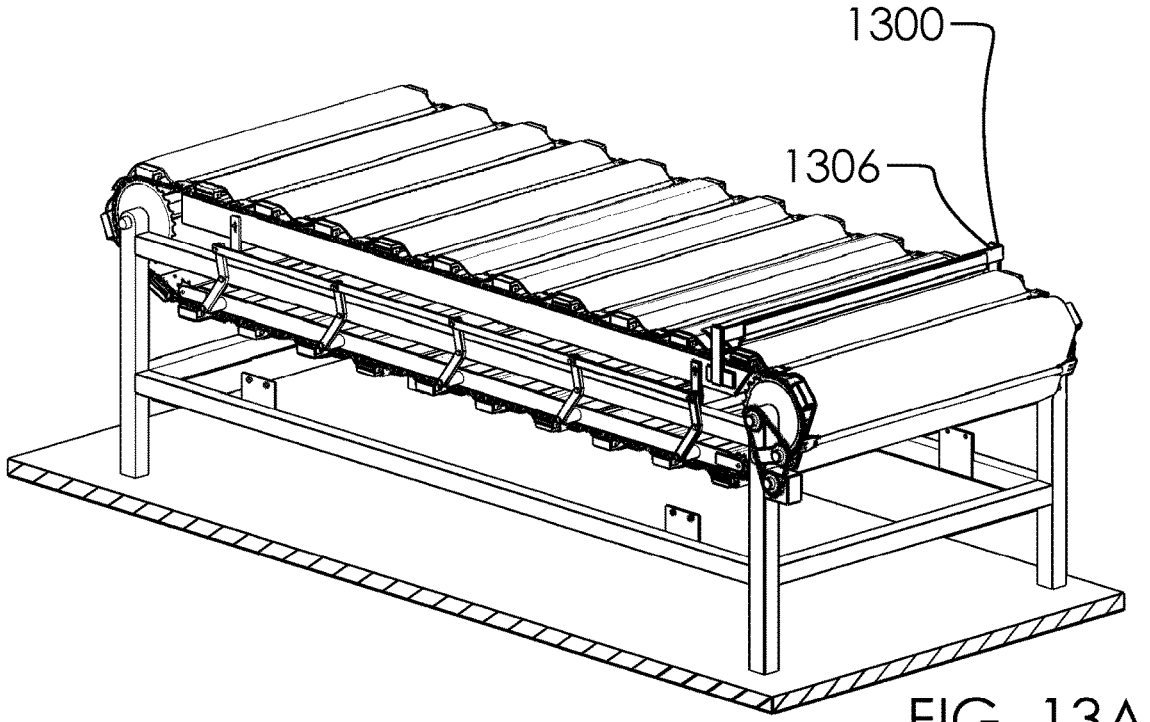
FIGS. 13A, and 13B illustrate a perspective overview and an elevated side view of an upper assembly 104 fully assembled.
Figure 13B:
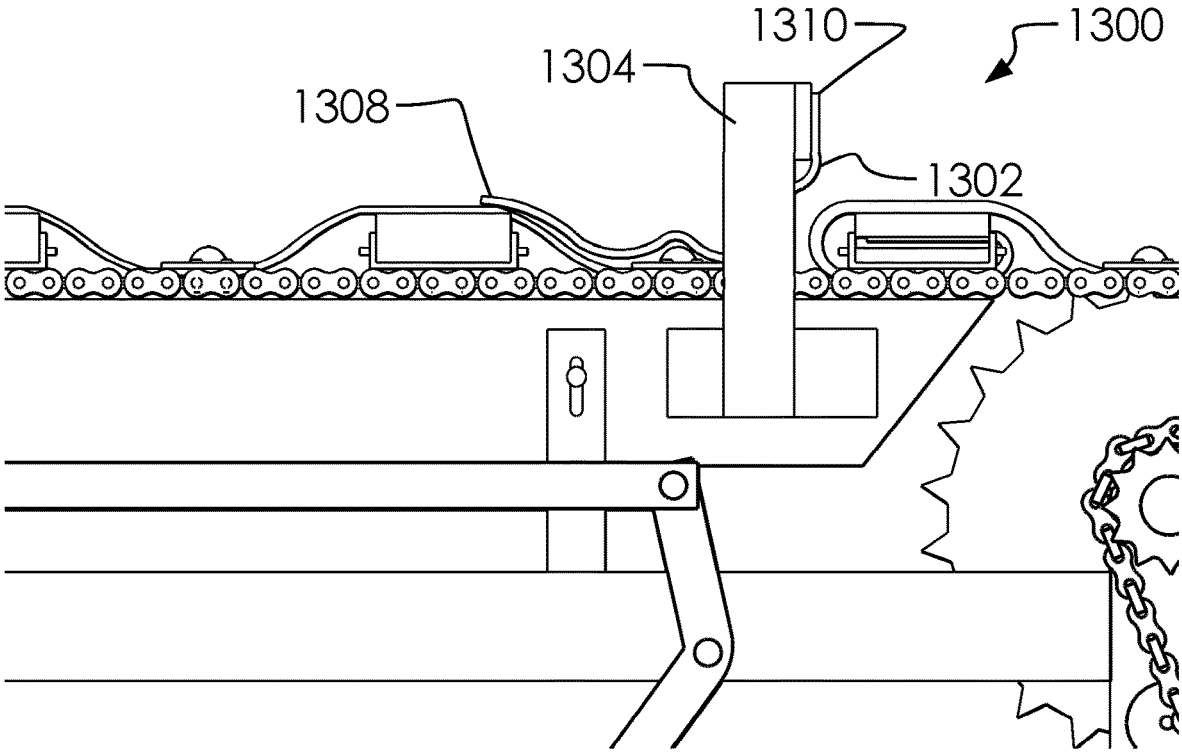

FIGS. 13A, and 13B illustrate a perspective overview and an elevated side view of said upper assembly 104 fully assembled.

In one embodiment, said wood sander 100 can comprise a wiper assembly 1300. In one embodiment, said wiper assembly 1300 can comprise a whipping textile 1302, two side risers 1304, and a crossbar 1306. Said whipping textile 1302 comprises a first end 1308 and a second end 1310. In one embodiment, said second end 1310 can attach to a portion of said crossbar 1306, and said first end 1308 can hang down and drag across portions of said plurality of sandpaper sheets 112. One purpose of said wiper assembly 1300 can be to knock off debris from said plurality of sandpaper sheets 112 which will enhance the usefulness of said wood sander 100 in sanding said target object 118.

Figure 14:
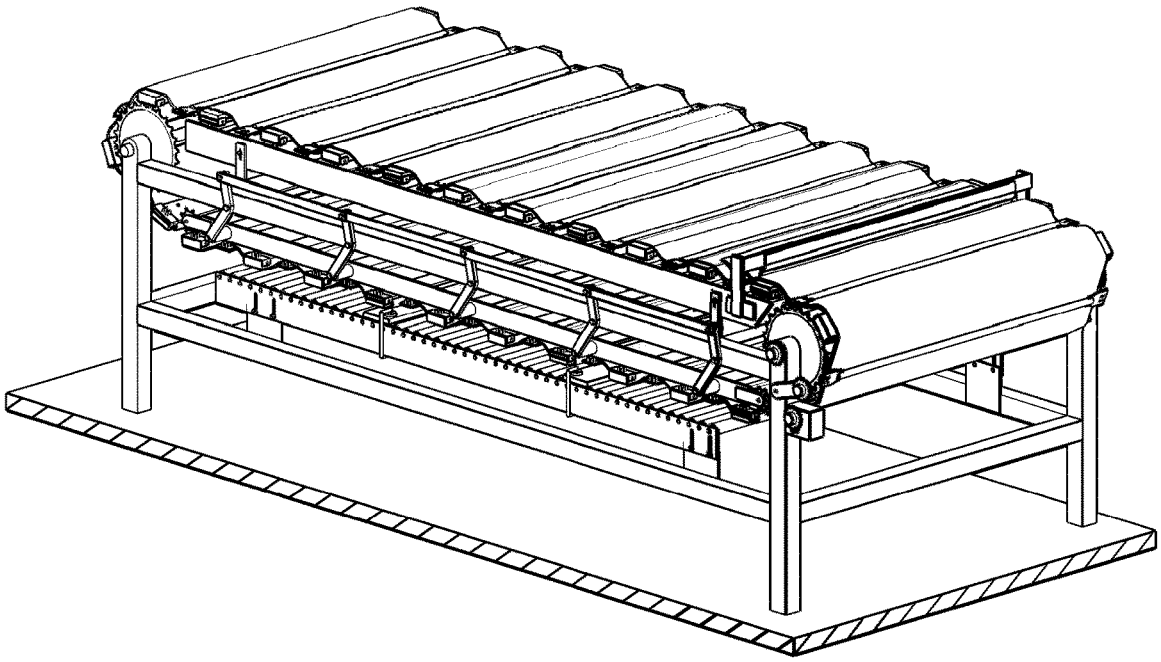
FIG. 14 illustrates a perspective overview of said wood sander 100, fully assembled.

FIG. 14 illustrates a perspective overview of said wood sander 100, fully assembled.

Figure 15A:
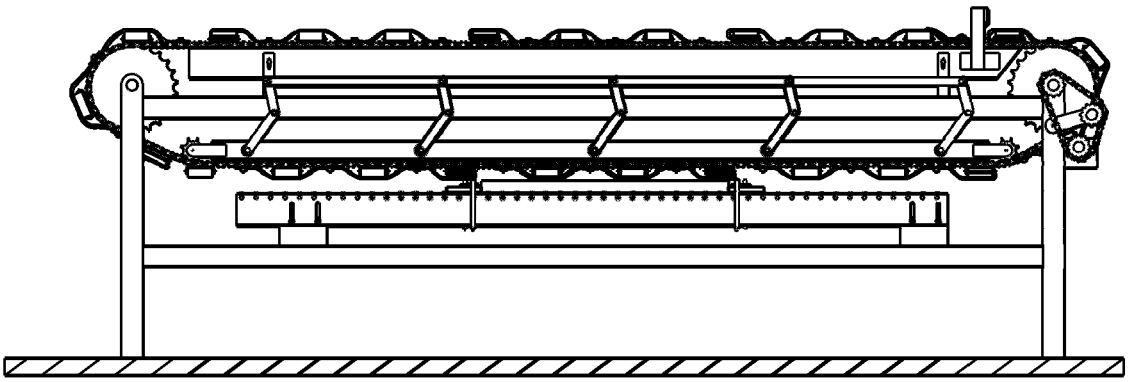
FIGS. 15A, and 15B illustrate an elevated side view of said wood sander 100 in said high configuration 500, and said second height configuration 400, respectively.
Figure 15B:
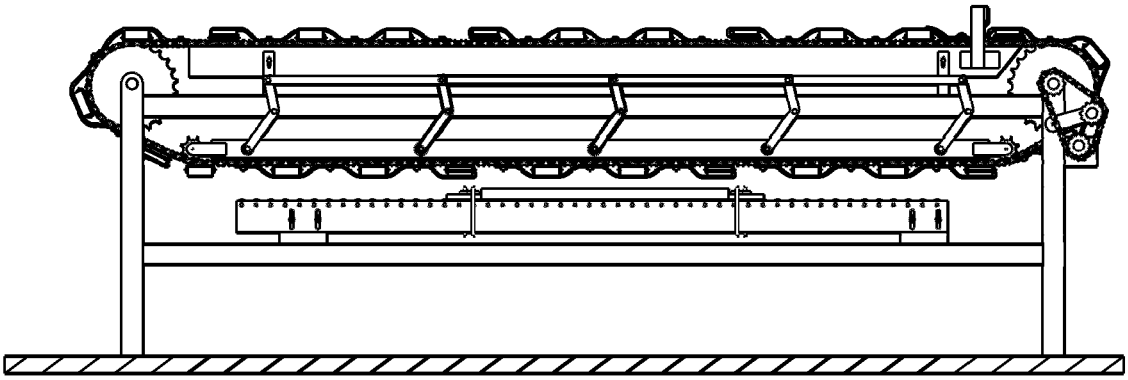

FIGS. 15A, and 15B illustrate an elevated side view of said wood sander 100 in said high configuration 500, and said second height configuration 400, respectively.

Figure 16A:
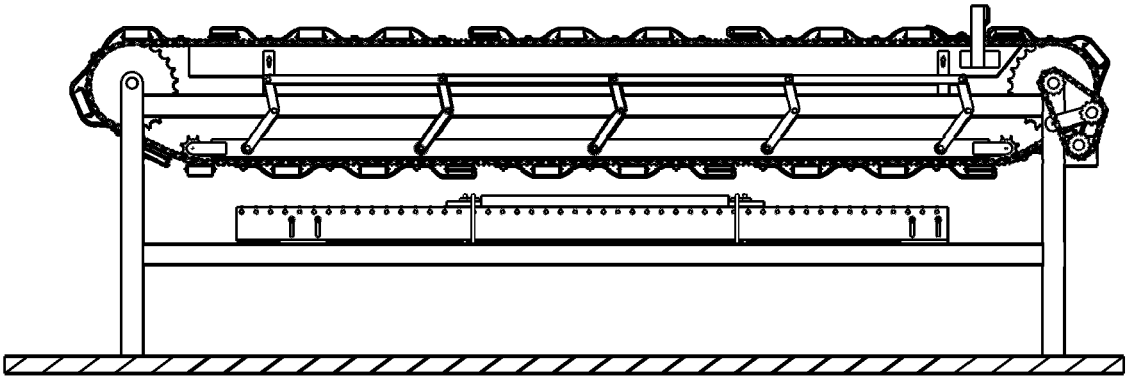
FIGS. 16A, and 16B illustrate an elevated side view of said wood sander 100 in said low configuration 334, with said chain 604 in said engaged configuration 700 and said slack configuration 600, respectively.
Figure 16B:
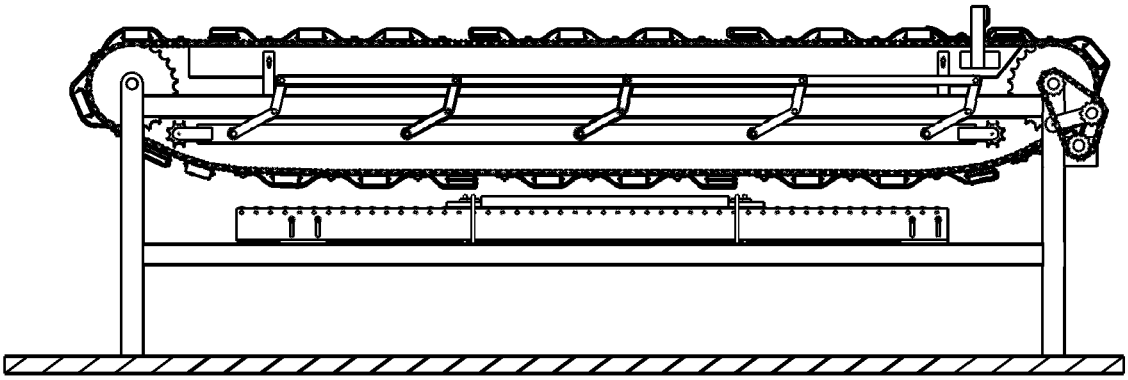

FIGS. 16A, and 16B illustrate an elevated side view of said wood sander 100 in said low configuration 334, with said chain 604 in said engaged configuration 700 and said slack configuration 600, respectively.

This listing of the parts in the specification is included for the convenience of the reader:

said wood sander 100,
said frame 102,
said upper assembly 104,
said lower assembly 106,
said ground surface 108,
said drive system 110,
said plurality of sandpaper sheets 112,
said path 114,
said platform 116,
said target object 118,
said variable engagement assembly 120,
said rotary power input 122,
said four or more corner posts 200,
said first corner post 200*a*,
said second corner post 200*b*,
said third corner post 200*c*,
said fourth corner post 200*d*,
said one or more lower side rails 202,
said first lower side rail 202*a*,
said second lower side rail 202*b*,
said two sides 204,
said first side 204*a*,
said second side 204*b*,
said two ends 206,
said first end 206*a*,
said second end 206*b*,
said one or more lower end rails 208,
said first lower end rail 208*a*,
said second lower end rail 208*b*,
said one or more drive rotating axes 210,
said first drive rotating axis 210*a*,
said second drive rotating axis 210*b*,
said one or more upper side rails 212,
said first upper side rail 212*a*,
said second upper side rail 212*b*,
said one or more upper side containment rails 214,
said first upper side containment rail 214*a*,
said second upper side containment rail 214*b*,
said one or more platform brackets 216,
said first platform bracket 216*a*,
said second platform bracket 216*b*,
said third platform bracket 216*c*,
said fourth platform bracket 216*d*,
said plurality of rollers 300,
said roller bed surface 302,
said first platform end 304,
said second platform end 306,
said clamping system 308,
said first end blocker 310*a*,
said second end blocker 310*b*,
said board 312,
said one or more locking grips 314,
said side supports 316,
said first side 316*a*,
said second side 316*b*,
said first end 318,
said second end 320,
said one or more slots 322,
said one or more fasteners 324,
said fastener head 326,
said height 328,
said top end 330,
said bottom end 332,
said low configuration 334,
said low configuration height 336,
said second height configuration 400,
said second height 402,
said high configuration 500,
said high configuration height 502,
said bottom end 504,
said top end 506,
said axial aperture 508,
said first drive system axis 510,
said second drive system axis 512,
said slack configuration 600,
said two sides 602,
said first side 602*a*,
said second side 602*b*,
said chain 604,
said two or more sprockets 606,
said first sprocket 606*a*,
said second sprocket 606*b*,
said third sprocket 606*c*,
said fourth sprocket 606*d*,
said two or more drive rods 608,
said first drive rod 608*a*,
said second drive rod 608*b*,
said top portion 610,
said bottom portion 612,
said diameter 614,
said rotational axis 616,
said plurality of teeth 618,
said plurality of chain link sockets 620, said lower bar 622,
said upper bar 624,
said plurality of rocker bars 626,
said one or more spacers 628,
said top fastener 630,
said lower fastener 632,
said center fastener 634,
said engaged configuration 700,
said sandpaper holder assembly 800,
said sandpaper sheet 802,
said one or more cross-members 804,
said first cross-member 804*a*,
said second cross-member 804*b*,
said third cross-member 804*c*,
said fourth cross-member 804*d*,
said fifth cross-member 804*e*,
said sixth cross-member 804*f*,
said clamping assembly 806,
said cross-member bar 808,
said cross-member board 810,
said mounting bracket 812,
said first end 814,
said top board 816,
said bottom board 818,
said second end 820,
said assembled configuration 900,
said wiper assembly 1300,
said whipping textile 1302,
said two side risers 1304,
said crossbar 1306,
said first end 1308, and
said second end 1310.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A wood sander for sanding a target object, wherein:
said wood sander comprises a frame, an upper assembly, a lower assembly, a drive system and a plurality of sandpaper sheets;
said drive system is configured for pulling said plurality of sandpaper sheets through a path;
said path is configured to cause said plurality of sandpaper sheets to touch a portion of said target object as said drive system rotates said plurality of sandpaper sheets;
said upper assembly comprises said drive system, and said plurality of sandpaper sheets;
said lower assembly comprises a platform configured to hold said target object;
said upper assembly and said lower assembly are attached to and supported by said frame;
said lower assembly is configured to be raised and lowered relative to a ground surface and adjust a position of said target object relative to said upper assembly, with;
a high configuration height in a high configuration,
a second height in a second height configuration, and
a low configuration height in a low configuration;
said lower assembly comprises side supports comprising a first side and a second side, and said platform;
said side supports each comprise
a first end and a second end, and
one or more slots at each end of said side supports;
said lower assembly comprises a one or more platform brackets, each comprising one or more fasteners having a fastener head;
said side supports are configured to attach to said lower assembly by inserting said fastener head through one or more slots;
said fastener head are configured to selectively slide within said one or more slots;
said one or more slots comprise a substantially vertical slot having a height, a top end and a bottom end; and
said lower assembly is configured to substantially move with a range of motion defined by said height of said one or more slots between said bottom end and said top end of said one or more slots.

2. The wood sander of claim 1, wherein:
said frame comprises four or more corner posts, one or more lower side rails, two or more sides, two ends, one or more lower end rails, one or more drive rotating axes,
said four or more corner posts comprise a first corner post, a second corner post, a third corner post, and a fourth corner post;
said two sides comprise a first side, and a second side;
said two ends comprise a first end, and a second end;
said one or more drive rotating axes comprise a first drive rotating axis, and a second drive rotating axis; and
said one or more lower end rails comprise a first lower end rail, and a second lower end rail.

3. The wood sander of claim 2, wherein:
said one or more lower side rails comprise a first lower side rail, and a second lower side rail;
a one or more upper side rails comprise a first upper side rail, and a second upper side rail; and
said one or more upper side rails support a chain at a top portion so as to align said chain between a first sprocket and a second sprocket.

4. The wood sander of claim 2, wherein:
said side supports comprise substantially planar members;
said platform comprises substantially horizontal surface for holding said target object;
said platform comprises a plurality of rollers to create a roller bed conveyance surface on said platform; and
said side supports are configured to hold an ends of said plurality of rollers.

5. The wood sander of claim 4, wherein:
said wood sander further comprises a clamping system for holding said target object on said platform;
said clamping system comprises a first end blocker and a second end blocker arranged on either side of said target object;
each of said first end blocker and said second end blocker comprise a board being pressed against either side of said target object and held in place with by one or more locking grips; and said one or more locking grips clamp around said board and a portion of said platform.

6. The wood sander of claim 2, wherein:

said frame further comprises one or more upper side containment rails; and said one or more upper side containment rails comprise a first upper side containment rail, and a second upper side containment rail.

7. The wood sander of claim 2, wherein:

said frame further comprises said one or more platform brackets; and said one or more platform brackets comprise a first platform bracket, a second platform bracket, a third platform bracket, and a fourth platform bracket.

8. The wood sander of claim 2, wherein:

each of said four or more corner posts comprises a substantially vertical support at the corners of said frame;

said first drive rotating axis is arranged at said first end of said frame, and runs through a portion of said first corner post and said second corner post;

said second drive rotating axis is arranged at said second end of said frame and runs through a portion of said third corner post and said fourth corner post;

said four or more corner posts comprises a bottom end and a top end;

said top end each of said four or more corner posts comprises an axial aperture;

said axial aperture of said first corner post is aligned with said axial aperture of said second corner post;

said axial aperture of said third corner post is aligned with said axial aperture of said fourth corner post;

said wood sander further comprises two or more drive rods comprising a first drive rod and a second drive rod;

said first drive rod runs between each said axial aperture of said first corner post and said second corner post;

said second drive rod runs between said axial aperture of said third corner post and said fourth corner post;

said drive system is arranged with said two sides comprising said first side and said second side;

each of said two sides comprise a two or more sprockets attached to said two or more drive rods, and said chain composed of a plurality of chain link sockets;

said two or more sprockets comprise at least said first sprocket and said second sprocket, with said first sprocket rotating about said first drive rotating axis and said second sprocket rotating about said second drive rotating axis;

said chain is wrapped around said two or more sprockets on each of said two sides to form said path;

said drive system is configured to pull said plurality of sandpaper sheets around said path between said two or more sprockets on said chain; and said chain is configured to circulate along said path according to a shape created by said two or more sprockets.

9. The wood sander of claim 8, wherein:

said path selectively changes between a slack configuration and an engaged configuration with a variable engagement assembly;

said two or more sprockets comprise said first sprocket, said second sprocket, a third sprocket and a fourth sprocket;

said slack configuration comprises a configuration of said two or more sprockets with said third sprocket and said fourth sprocket unengaged with said chain, said top portion of said chain substantially tight between said first sprocket and said second sprocket, and a bottom portion of said chain hanging unengaged below said third sprocket and said fourth sprocket; and said variable engagement assembly comprises, on each side of said two sides, a lower bar, an upper bar, and a plurality of rocker bars.

10. The wood sander of claim 9, wherein:

one or more spacers are used to connect said plurality of rocker bars to parts of said variable engagement assembly.

11. The wood sander of claim 9, wherein:

said plurality of rocker bars are arranged along the length of and rotationally attached to said lower bar, said one or more upper side rails and said upper bar;

said plurality of rocker bars are configured to allow said upper bar to rotate about a top fastener, said lower bar to rotate about a lower fastener, and said plurality of rocker bars rotates about a fixed axis at a center fastener.

12. The wood sander of claim 9, wherein:

each of said two or more sprockets comprises a diameter, a rotational axis, and a plurality of teeth; and said plurality of teeth of said two or more sprockets engage with said plurality of chain link sockets in said chain.

13. The wood sander of claim 8, wherein:

said wood sander comprises a sandpaper holder assembly;

said sandpaper holder assembly comprises a sandpaper sheet, and one or more cross-members;

each of said one or more cross-members comprises a mounting bracket on each end;

said one or more cross-members of said sandpaper holder assembly attach to said chain with said mounting bracket;

with said one or more cross-members attached to said chain, said chain is still capable of rotating around said path and said two or more sprockets unimpeded; and said mounting bracket is configured to selectively attach to said chain to hold said sandpaper holder assembly to said chain.

14. The wood sander of claim 13, wherein:

said sandpaper sheet attaches to a portion of said one or more cross-members and weaves above and below said one or more cross-members;

said one or more cross-members comprises different varieties including a clamping assembly, a cross-member bar;

said clamping assembly is configured to clamp around a first end of said sandpaper sheet by securing said first end between a top board and a bottom board; and a second end of said sandpaper sheet is configured to remain lose so that said sandpaper holder assembly is configured to stretch and flex as said drive system rotates through said path.

15. The wood sander of claim 13, wherein:

said one or more cross-members comprises a first cross-member, a second cross-member, a third cross-member, a fourth cross-member, a fifth cross-member, and a sixth cross-member; and said one or more cross-members further comprises different varieties including a cross-member board.

16. The wood sander of claim 13, wherein:

said wood sander comprises a wiper assembly;

said wiper assembly comprises a whipping textile, two side risers, and a crossbar;

said whipping textile comprises a first end and a second end;

said second end is configured to attach to a portion of said crossbar, and said first end is configured to hang down and drag across portions of said plurality of sandpaper sheets; and one purpose of said wiper assembly is to knock off debris from said plurality of sandpaper sheets which will enhance the usefulness of said wood sander in sanding said target object.

17. A wood sander for sanding a target object, wherein:

said wood sander comprises a frame, an upper assembly, a lower assembly, a drive system and a plurality of sandpaper sheets;

said drive system is configured for pulling said plurality of sandpaper sheets through a path;

said path is configured to cause said plurality of sandpaper sheets to touch a portion of said target object as said drive system rotates said plurality of sandpaper sheets;

said upper assembly comprises said drive system, and said plurality of sandpaper sheets;

said lower assembly comprises a platform configured to hold said target object;

said upper assembly and said lower assembly are attached to and supported by said frame;

each of a four or more corner posts comprises a substantially vertical support at the corners of said frame;

a first drive rotating axis is arranged at a first end of said frame, and runs through a portion of a first corner post and a second corner post;

a second drive rotating axis is arranged at a second end of said frame and runs through a portion of a third corner post and a fourth corner post;

said four or more corner posts comprises a bottom end and a top end;

said top end each of said four or more corner posts comprises an axial aperture;

said axial aperture of said first corner post is aligned with said axial aperture of said second corner post;

said axial aperture of said third corner post is aligned with said axial aperture of said fourth corner post;

said wood sander further comprises two or more drive rods comprising a first drive rod and a second drive rod;

said first drive rod runs between each said axial aperture of said first corner post and said second corner post;

said second drive rod runs between said axial aperture of said third corner post and said fourth corner post;

said drive system is arranged with a two sides comprising a first side and a second side;

each of said two sides comprise two or more sprockets attached to said two or more drive rods, and a chain composed of a plurality of chain link sockets;

said two or more sprockets comprise at least a first sprocket and a second sprocket, with said first sprocket rotating about said first drive rotating axis and said second sprocket rotating about said second drive rotating axis;

said chain is wrapped around said two or more sprockets on each of said two sides to form said path;

said drive system is configured to pull said plurality of sandpaper sheets around said path between said two or more sprockets on said chain;

said chain is configured to circulate along said path according to a shape created by said two or more sprockets;

said path selectively changes between a slack configuration and an engaged configuration with a variable engagement assembly;

said two or more sprockets comprise said first sprocket, said second sprocket, a third sprocket and a fourth sprocket;

said slack configuration comprises a configuration of said two or more sprockets with said third sprocket and said fourth sprocket unengaged with said chain, a top portion of said chain substantially tight between said first sprocket and said second sprocket, and a bottom portion of said chain hanging unengaged below said third sprocket and said fourth sprocket;

said variable engagement assembly comprises, on each side of said two sides, a lower bar, an upper bar, and a plurality of rocker bars;

said wood sander comprises a sandpaper holder assembly;

said sandpaper holder assembly comprises a sandpaper sheet, and one or more cross-members;

each of said one or more cross-members comprises a mounting bracket on each end;

said one or more cross-members of said sandpaper holder assembly attach to said chain with said mounting bracket;

with said one or more cross-members attached to said chain, said chain is still capable of rotating around said path and said two or more sprockets unimpeded; and said mounting bracket is configured to selectively attach to said chain to hold said sandpaper holder assembly to said chain.

18. A wood sander for sanding a target object, wherein:

said wood sander comprises a frame, an upper assembly, a lower assembly, a drive system and a plurality of sandpaper sheets;

said drive system is configured for pulling said plurality of sandpaper sheets through a path;

said path is configured to cause said plurality of sandpaper sheets to touch a portion of said target object as said drive system rotates said plurality of sandpaper sheets;

said upper assembly comprises said drive system, and said plurality of sandpaper sheets;

said lower assembly comprises a platform configured to hold said target object;

said upper assembly and said lower assembly are attached to and supported by said frame;

said frame comprises four or more corner posts, one or more lower side rails, two or more sides, two ends, one or more lower end rails, one or more drive rotating axes, said four or more corner posts comprise a first corner post, a second corner post, a third corner post, and a fourth corner post;

said two sides comprise a first side, and a second side;

said two ends comprise a first end, and a second end;

said one or more drive rotating axes comprise a first drive rotating axis, and a second drive rotating axis;

said one or more lower end rails comprise a first lower end rail, and a second lower end rail;

each of said four or more corner posts comprises a substantially vertical support at the corners of said frame;

said first drive rotating axis is arranged at said first end of said frame, and runs through a portion of said first corner post and said second corner post;

said second drive rotating axis is arranged at said second end of said frame and runs through a portion of said third corner post and said fourth corner post;

said four or more corner posts comprises a bottom end and a top end;

said top end each of said four or more corner posts comprises an axial aperture;

said axial aperture of said first corner post is aligned with said axial aperture of said second corner post;

said axial aperture of said third corner post is aligned with said axial aperture of said fourth corner post;

said wood sander further comprises two or more drive rods comprising a first drive rod and a second drive rod;

said first drive rod runs between each said axial aperture of said first corner post and said second corner post;

said second drive rod runs between said axial aperture of said third corner post and said fourth corner post;

said drive system is arranged with said two sides comprising said first side and said second side;

each of said two sides comprise a two or more sprockets attached to said two or more drive rods, and said chain composed of a plurality of chain link sockets;

said two or more sprockets comprise at least said first sprocket and said second sprocket, with said first sprocket rotating about said first drive rotating axis and said second sprocket rotating about said second drive rotating axis;

said chain is wrapped around said two or more sprockets on each of said two sides to form said path;

said drive system is configured to pull said plurality of sandpaper sheets around said path between said two or more sprockets on said chain; and said chain is configured to circulate along said path according to a shape created by said two or more sprockets.

* * * * *